US005141195A

United States Patent [19]

Toda et al.

[11] Patent Number: 5,141,195

[45] Date of Patent: Aug. 25, 1992

[54] COUNTERWEIGHT REMOVAL DEVICE

[75] Inventors: Tadashi Toda, Kobe; Jun-ichi Shimizu, Takasago; Kobayashi Nobuyuki, Kobe; Hideyuki Izumi, Akashi; Tsuruo Hamamoto, Akashi; Norio Nakajima, Akashi; Shigeru Kojima, Asashi, all of Japan

[73] Assignee: Shin Caterpillar Mitsubishi Ltd., Tokyo, Japan

[21] Appl. No.: 535,528

[22] Filed: Jun. 11, 1990

[30] Foreign Application Priority Data

Jun. 19, 1989 [JP] Japan ..... 1-071315[U]

[51] Int. Cl.[5] ..... B66C 23/72

[52] U.S. Cl. ..... 248/364; 212/197; 414/719

[58] Field of Search ..... 414/719, 673; 901/48; 212/195, 196, 197, 198; 248/364

[56] References Cited

U.S. PATENT DOCUMENTS

| | | | |
|---|---|---|---|
| 3,891,095 | 6/1975 | Symmank | 414/719 X |
| 3,902,735 | 9/1975 | Bertram et al. | 212/197 X |
| 4,029,340 | 6/1977 | Chelin | 414/719 X |
| 4,197,806 | 4/1980 | Laxo | 212/195 X |
| 4,402,413 | 9/1983 | Sickler | 414/719 X |
| 4,518,305 | 5/1985 | Stuhrmann | 414/719 |

FOREIGN PATENT DOCUMENTS

| | | | |
|---|---|---|---|
| 0144396 | 10/1980 | Fed. Rep. of Germany | 212/195 |
| 0270894 | 8/1989 | Fed. Rep. of Germany | 212/196 |

*Primary Examiner*—Frank E. Werner
*Assistant Examiner*—James Eller
*Attorney, Agent, or Firm*—Fleit, Jacobson, Cohn, Price, Holman & Stern

[57] ABSTRACT

A counterweight handling device for construction equipment such as cranes in which a counterweight can be elevated to a predetermined height by using particulate hydraulic components then supported on a mounting frame. The counterweight may be supported by a pair of rectangular rotating blocks mounted on the counterweight mounting frame and which slide through a pair of vertical grooves in vertical position into supporting hollows in the counterweight bottom and turn through 90° so as to support the counterweight by blocking the vertical grooves. Alternatively a pair of sliding pins mounted on the counterweight mounting frame may be extended into inverted V shaped notches on the counterweight bottom so as to support the counter weight. The counterweight can then be fastened on the counterweight mounting frame. Later the counterweight can be removed.

3 Claims, 5 Drawing Sheets

COUNTERWEIGHT REMOVAL DEVICE

2. BACKGROUND OF THE INVENTION

The present invention relates to a counterweight removal device for construction equipments such as cranes and hydraulic excavators. Regarding a counterweight for this type of conventional construction machine, it is common for the swing frame to be provided with horizontal weight bearing extensions on its rear end, on which the counterweight is placed so as to be screwed on said frame. However, said counterweight has to be lifted so as to clear the weight bearing extensions and moved forward so as to lean against the mounting frame and fixed with set screws, because the weight bearing extensions themselves stand on the uplifting route of the counterweight.

It is therefore, necessary to have some means for lifting or lowering the counterweight vertically and for moving it forward or backward. The crane or the like requires other auxiliary heavy equipment for handling proper counterweight in the field, or some proper heavy device of complicated structure just to mount and dismount the counterweight.

Shown in the FIG. 8 is a counterweight handling system, disclosed by the Japanese Patent Application Laid-open No. 59-1625, wherein a lift cylinder for operating an arm pivoted on the rear end of a swing frame of said equipment is mounted for replacing said counterweight and bearing an extension, by which the counterweight is lifted so as to be fixed on the swing frame with shear pins and set screws.

However, it is necessary to provide an arm pivoted on the frame and a lift cylinder on the counterweight lifting system as aforementioned. The counterweight mounting operation is not easy because of hard positioning of shear pins for bearing a counterweight. Further, this type of counterweight lifting system is rather expensive.

SUMMARY OF THE INVENTION

The present invention was developed considering the above situation and is to provide a counterweight removal device, whereby it is enough to only lift and lower the counterweight vertically for removing.

In order to carry out above purpose according to the present invention, a counterweight removal device is provided, either comprising two rectangular rotating beds incorporated with pins for pivoting rotatively on a counterweight mounting frame provided on the rear end of a swing frame or comprising two supporting pins mounted slidably on the rear end of counterweight mounting frame for extending out from the mounting frame The device further comprises two weight lifting systems mounted on the counterweight mounting frame and said counterweight is provided with long vertical grooves on the back for mounting said weight lifting systems. In the case of rotating beds the counterweight is provided with guide grooves with supporting hallows in the lower portions of the guide grooves on the back of the counterweight, wherein said rotating beds slides in the upper groove portion in vertical position and rotate in said supporting hollows. In the case of supporting pins the counterweight is provided with notched hollows in an inverted V-shaped form on the bottom of the counterweight on the back of the counterweight, wherein said slidable pins can extend out. In either case the counterweight is constructed so as to be fixed on said counterweight mounting frame with set screws.

BRIEF DESCRIPTION OF THE DRAWINGS

FIG. 1(*b*) shows a front view of a second embodiment.

FIG. 2(*b*) shows a plan view of the second embodiment.

EMBODIMENT

Figure 1A:
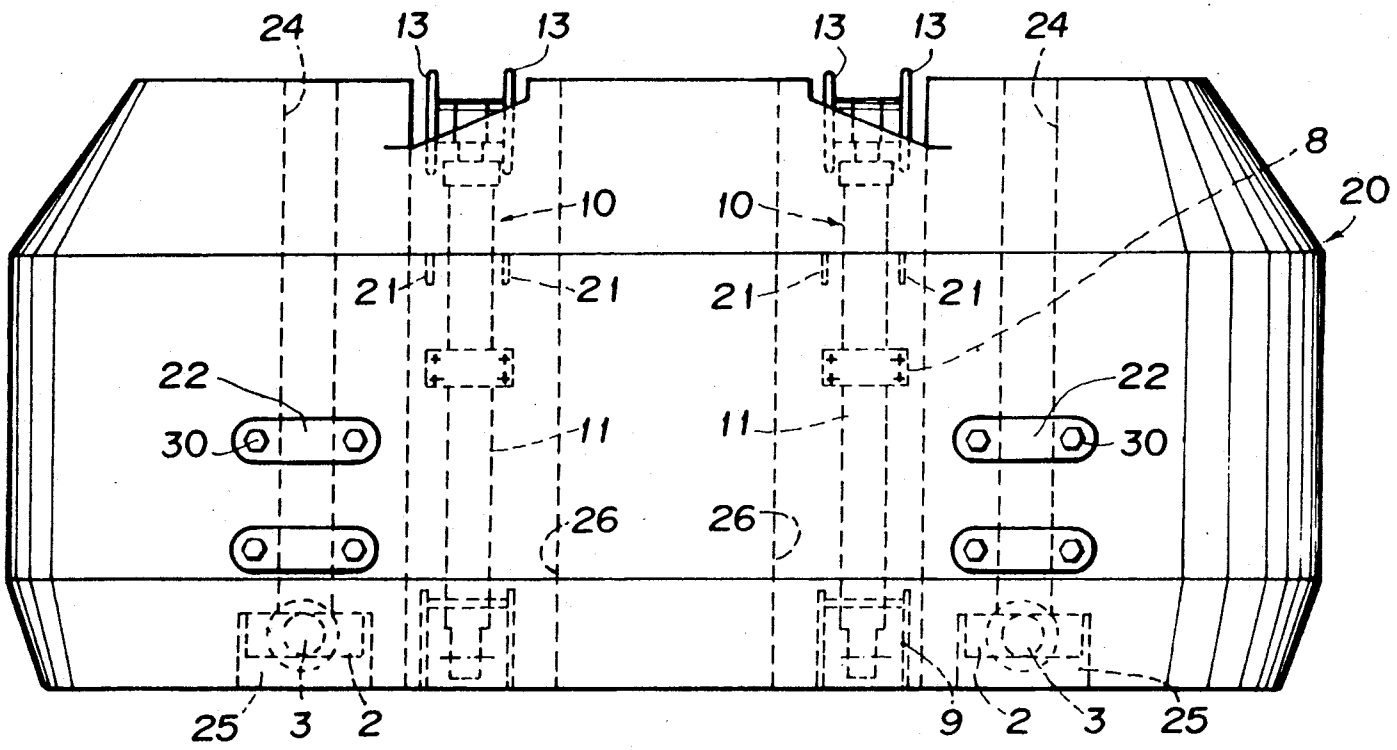
FIG. 1(*a*) shows a front view of a first embodiment according to the present invention.

Hereinafter, an embodiment according to the present invention will be explained referring to the drawings.

Figure 1B:
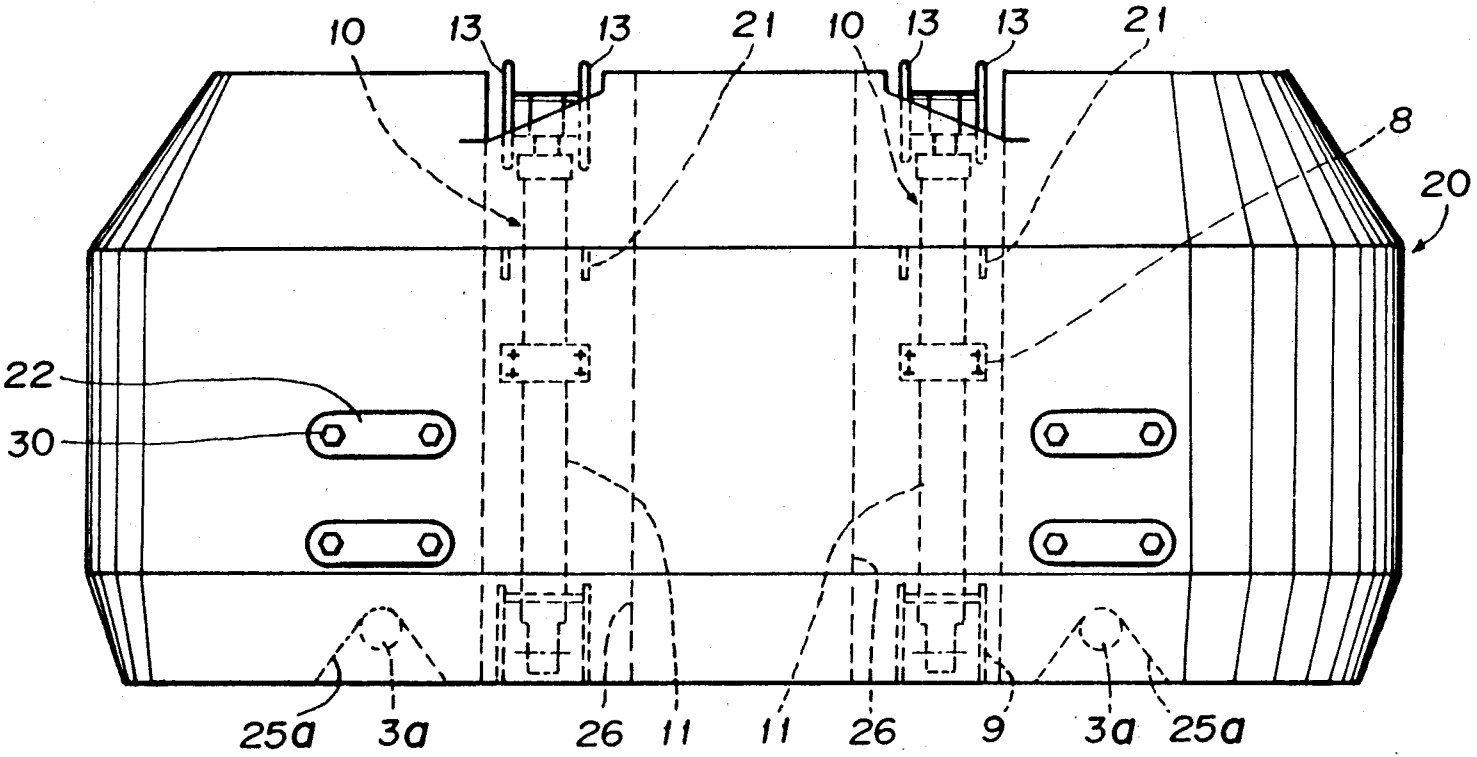
Figure 2A:
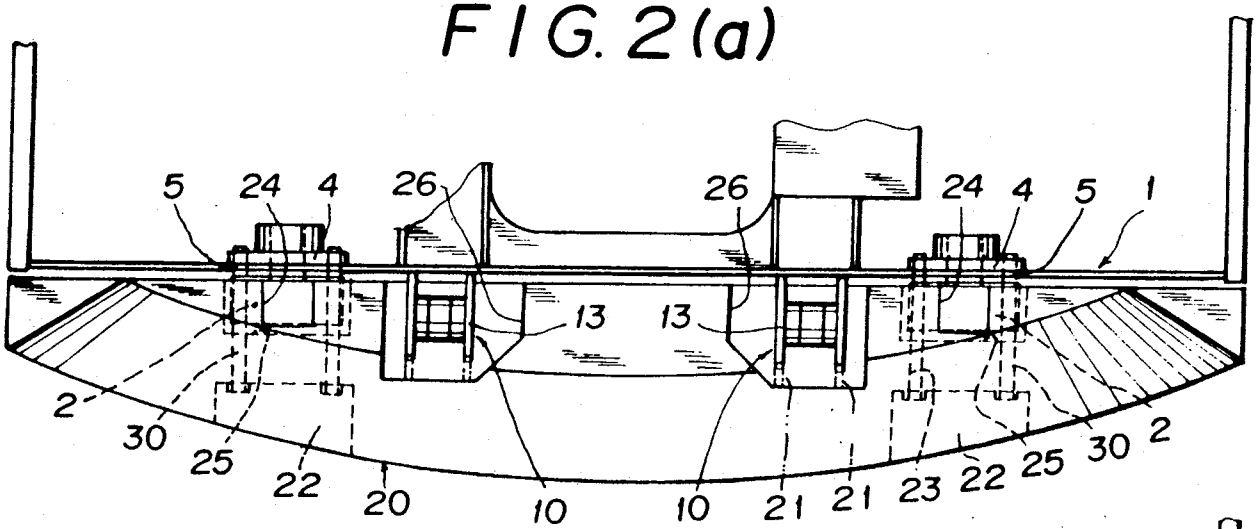
FIG. 2(*a*) shows is a plan view.
Figure 2B:
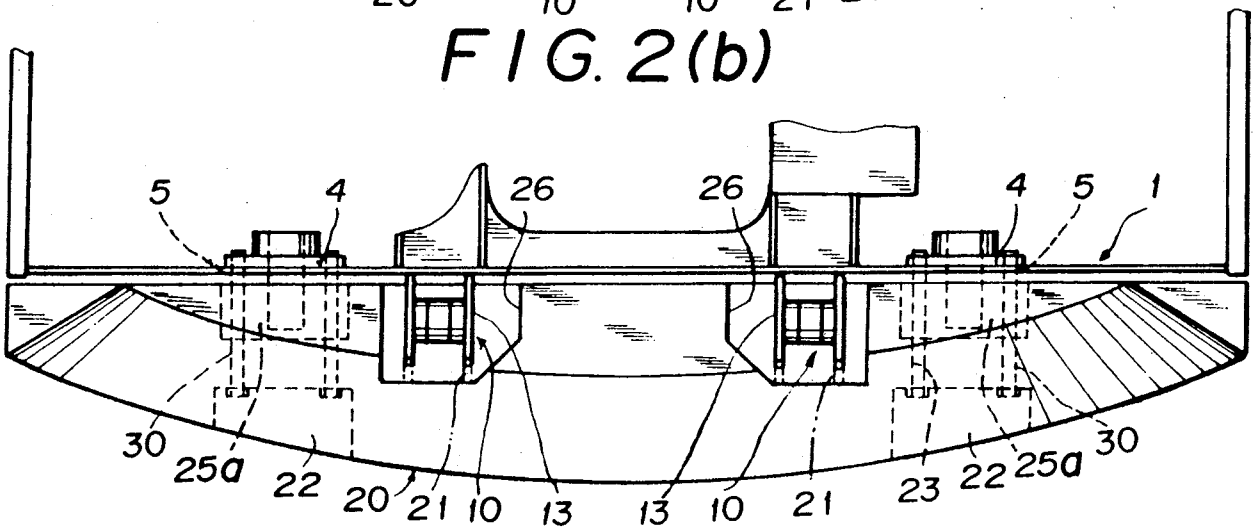
Figure 3:
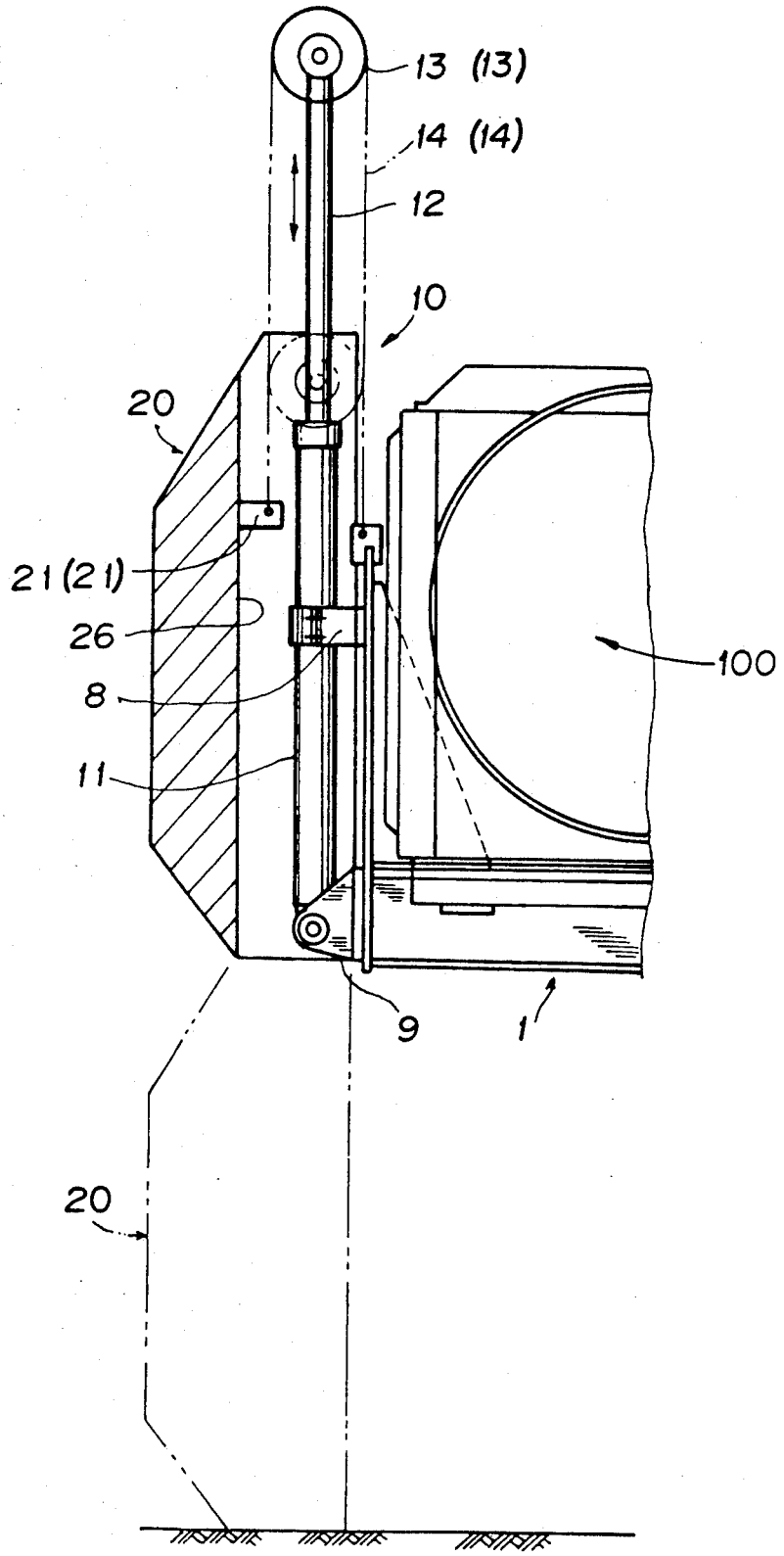
FIG. 3 illustrates a cross section of a counterweight lifting device.

According to FIGS. 1(*a*), 2(*a*), 3, 4 and 5, numeral 1 indicates a counterweight mounting frame provided on the rear end of a construction machine 100 (See FIG. 3). A pair of rectangular rotating beds 2 incorporated with pin 3 are rotatably mounted on the lower part of a weight mounting frame. On the upper portions of each rotating bed 2, through holes 5 are provided for inserting set screws 30 to be explained later. On the back of counterweight, back plates with threaded holes 4 are mounted. A pair of weight lifting systems 10 are mounted in the inner grooves in relation to the rotating beds with bracket 8 and 9, and on the upper ends of piston rod to be lifted or lowered by oil pressure in the cylinder 11, sprockets 13 are mounted, with which chains 14 are engaged. The front ends of the chain 14 are fixed on the counterweight mounting frame 1 as shown in the FIG. 3 and other ends are mounted detachably on the fixing plates 21 provided in the vertical grooves 26.

The counterweight 20 has hollows 22 wherein through holes 23 are formed as shown in the FIGS. 1(*a*) and 2(*a*). On the back of counterweight 20, a pair of guide groove are formed vertically. On the lower ends of each of guide grooves 24, a supporting hollow 25 which is wider than said guide grooves is formed.

Further, a pair of grooves 26 for mounting said weight lifting systems 10 are formed vertically between the guide grooves 24 on the back of counterweight 20.

Figure 4:
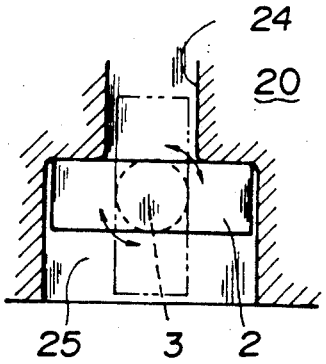
FIG. 4 shows an amplifier rear view of a weight rotating bed.
Figure 5:
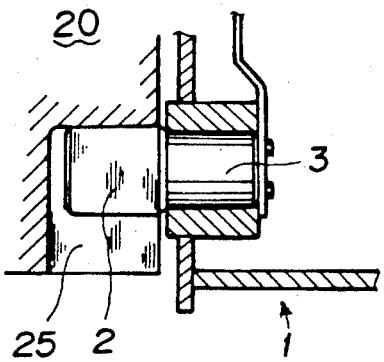
FIG. 5 shows an amplified side view of the rotating bed.
Figure 6:
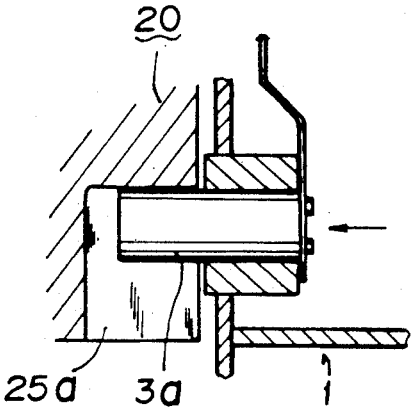
FIG. 6 shows an amplified side view of a protruding supporting pin.

In the FIGS. (b), 2(*b*), 3, 6 and 7, in a second embodiment lifting systems are the same as in the first embodiment. There are a pair of supporting pins 3*a* in the place of rectangular rotating beds. The counterweight has a pair of notches in inverted V-shaped form 25*a* at the identical positions of and in the place of the guide grooves of the first embodiment. Operation of the present system will be explained. In order to mount the counterweight 20 on the swing frame, the rotating beds 2 have to be turned first so as to be put in a vertical position as illustrated with double chain lines in FIG. 4. Then the free rear ends of chain 14 have to be fixed on the fixing plates 21 of counterweight on the ground using bolts or equivalents and the piston rods 12 are extended by driving the lift cylinders 11. Then the counterweight 20 is lifted up being driven by the sprockets 13 and the chains 14, but the rotating beds 2 do not block the guide grooves 24 on the back of counterweight 20, because they slide freely through the guide grooves 24. When the counterweight 20 is elevated to the height where the rotating beds 2 may turn in the supporting hollows 25 formed on the lower end of guide grooves 24. Then, after finishing the lifting operation of the counterweight, the rotating beds can be turned 90° so as to be positioned horizontally as shown with a line in the FIG. 4. Then the counterweight can be lowered a little so as to be placed on the rotating beds 2. Accordingly the counterweight can be fixed on the counterweight mounting frame with set screws 30 inserted in the through holes 23 and the fixing plates 4.

However, the frequency of replacement of the counterweight is not so high generally, therefore the chains 14 can be taken off and the piston rods 12 can be kept retracted in the lowest position of cylinders 11 after having mounted the counterweight. Further, the cylinders can be covered with some protectors or taken off for storing.

Also in order to take off the counterweight 20 after taking off the set screws 30 first, the counterweight 20 has to be lifted until the rotating beds 2 may be put in vertical position turning 90°. Then the counterweight 20 has to be lowered down to the ground letting the rotating beds 2 slide in the guide grooves 24, then the chains can be taken off At the time of lifting the counterweight, the rotating beds are vertically positioned so as to slide freely through the guide grooves and then positioned horizontally in the supporting hollow so as to receive the counterweight on themselves when the counterweight is lowered. Then the counterweight can be fixed on the counterweight mounting frame with set screws.

Figure 7:
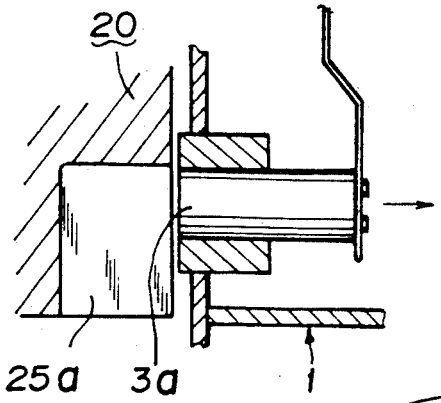
FIG. 7 shows an amplified lateral view of a retracted supporting pin.
Figure 8:
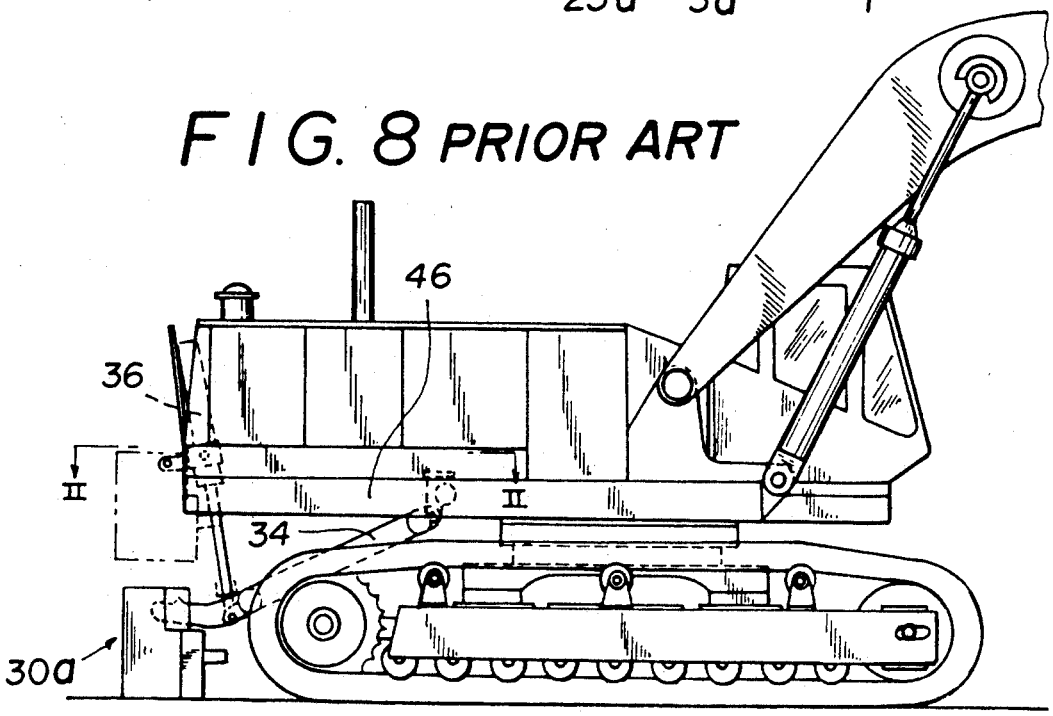
FIG. 8 PRIOR ART
FIG. 8 shows a side view of prior art.

As shown in the FIGS. 1(*b*), 2(*b*), 6 and 7, in a counterweight removal device comprising supporting pins 3*a* and notched hollows 25*a*, when the counterweight is lifted, the supporting pins 3*a* are retracted back into the mounting frame 1 as shown in the FIG. 7 not staying in the uplifting rout of the counterweight. When the counterweight is lifted up clearing the height of pins 3*a*, the slidable pins can be extended out under the counterweight. Then the counterweight 20 can be positioned on the pins 3*a* by means of notched portions 25*a* so as to be fixed on the counterweight mounting frame with set screws 30.

In order to take off the counterweight 20, the same process has to be done in reverse order and the supporting pins 3*a* can be retracted back into the counterweight mounting frame 1.

According to the present invention aforementioned, it is sufficient to mount two weight lifting systems of simple construction which may work vertically, therefore the counterweight mounting systems themselves can be simplified and the weight lifting systems will not disturb other operations, because they are mounted in the grooves on the back of the counterweight. In addition, the positioning of the counterweight can be done easily and exactly, because the counterweight can be fixed on the swing frame after being placed on the rotating beds or on the supporting pins. Accordingly the counterweight mounting operation in the field can be largely simplified.

What is claimed is:

1. A counterweight removal device comprising;

a counterweight mounting frame;

a counterweight supporting means mounted on the counterweight mounting frame for supporting the counterweight in position on the frame;

counterweight lifting means mounted on the rear end of said counterweight mounting frame for lifting the counterweight into position on the counterweight mounting frame;

a counterweight for fixing on said counterweight mounting frame, having a plurality of substantially vertical grooves for receiving said counterweight lifting means, and a plurality of support points for engaging with said counterweight supporting means, wherein the supporting means includes counterweight supporting members and the support points are hollows in the counterweight to receive the supporting members, wherein the counterweight supporting members include rectangular rotating blocks, wherein said hollows are formed horizontally at the lower end of the grooves formed on the back of the counterweight for receiving the rotating blocks, wherein said hollows are rectangular and the rotating blocks are rotatably mounted on the counterweight mounting frame so as to slide vertically in the grooves when said blocks are oriented in a substantially vertical position and engage in said rectangular hollows when said blocks are oriented in a substantially horizontal position.

2. A device according claim 1, wherein the counterweight lifting means comprise hydraulic components mounted on the counterweight mounting frame.

3. A device according to claim 1, wherein the grooves are formed substantially vertically in the back of the counterweight for receiving the counterweight lifting means.

* * * * *